US007552609B2

(12) United States Patent
Choi

(10) Patent No.: US 7,552,609 B2
(45) Date of Patent: Jun. 30, 2009

(54) PIERCING DEVICE OF HYDROFORMING MOLD

(75) Inventor: Yong Seok Choi, Ulsan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 12/006,369

(22) Filed: Jan. 2, 2008

(65) Prior Publication Data

US 2009/0038357 A1 Feb. 12, 2009

(30) Foreign Application Priority Data

Aug. 9, 2007 (KR) ..... 10-2007-0080218

(51) Int. Cl.
*B21D 53/88* (2006.01)
*B21D 26/02* (2006.01)

(52) U.S. Cl. ..... 72/55; 72/56; 72/370.27; 29/421.1; 83/53

(58) Field of Classification Search ..... 72/54, 72/55, 56, 58, 370.27; 29/421.1; 83/53
See application file for complete search history.

(56) References Cited

U.S. PATENT DOCUMENTS 6,442,820 B1 * 9/2002 Mason ..... 29/421.1
6,915,672 B1 * 7/2005 Ghiran et al. ..... 72/55
7,003,995 B2 * 2/2006 Ghiran et al. ..... 72/325
7,159,426 B1 * 1/2007 Ghiran ..... 72/55
7,249,480 B2 * 7/2007 Ghiran et al. ..... 72/370.27

* cited by examiner

*Primary Examiner*—David B Jones
(74) *Attorney, Agent, or Firm*—Edwards Angell Palmer & Dodge LLP; Peter F. Corless

(57) ABSTRACT

Disclosed is a piercing device of a hydroforming mold with a lower steel having a cavity therein, which can make the replacement of the pierce punch easier. The piercing device comprises: a pierce punch, the front edge portion of which is inserted into the cavity, for punching a hole through a molding material; a pierce cylinder for providing hydraulic pressure; a rod connected to the pierce cylinder, which is to be operated by the hydraulic pressure; and a pierce block connecting the rod and the pierce punch, wherein the length between the front edge portion of the rod and the pierce punch is greater than the length of the pierce punch.

8 Claims, 5 Drawing Sheets

Prior Art

Prior Art

PIERCING DEVICE OF HYDROFORMING MOLD

CROSS-REFERENCE TO RELATED APPLICATION

This application claims under 35 U.S.C. §119(a) the benefit of Korean Patent Application No. 10-2007-0080218 filed on Aug. 9, 2007, the entire contents of which are incorporated herein by reference.

BACKGROUND

1. Technical Field

The present invention relates to a piercing device of a hydroforming mold, and more particularly, to a piercing device of a hydroforming mold, which enables a pierce punch of the pierce device to be replaced in a simpler way.

2. Background Art

FIG. 1 is a perspective view showing a hydroforming mold in which a prior art piercing device is placed on a lower steel. FIG. 2 is a block diagram of the piercing device of a hydroforming mold of FIG. 1.

As shown in FIGS. 1 and 2, a piercing device is placed on a lower steel 1 in a hydroforming mold, and the piercing device includes a pierce cylinder 3 for receiving a hydraulic pressure from hydraulic piping 2, a pierce punch 5 whose front edge portion is inserted into a cavity provided within the lower steel 1 in order to punch a hole through a molding material by a rod 4 operating by the hydraulic pressure of the pierce cylinder 3, a pierce connector 6 for applying the operation of the rod 4 to the pierce punch 5, and a punch holder 7 for holding the pierce punch 5 to the pierce connector 6.

Herein, a recess portion 4' of a predetermined shape is provided on the rod 4 so as to couple one end portion 6' of the pierce connector 6 thereto by fitting. More specifically, the one end portion 6' of the pierce connector 6 is formed longitudinally so as to have a T-shaped cross section, and the recess portion 4' of the rod 4 is formed corresponding to the shape of the one end portion 6' of the pierce connector 6 so as to be coupled thereto downward by fitting.

A plurality of fastening holes 3*a* are formed on the top surface of the pierce cylinder 3, and bolts (not shown) are inserted through the fastening holes 3*a* to fix the pierce cylinder 3 to the lower steel 1.

The pierce connector 6 and the punch holder 7 are fastened by bolts (not shown), and an adjust plate 8 serving as a washer is placed between the pierce connector 6 and the punch holder 7.

In the thus-constructed piercing device of a hydroforming mold, when the rod 4 is operated by the hydraulic pressure applied from the pierce cylinder 3, the pierce punch 5 connected to the rod 4 by the pierce connector 6 operates to punch a hole through a product.

The pierce punch 5 is abraded after a long period of use. The pierce punch 5 abraded to a large extent increases the fraction defective of holes when punching a hole through a molding material, and thus is required to be replaced by a new pierce punch 5 for use.

The prior art piercing device, however, has drawbacks in that for the replacement of pierce punch 5, the pierce cylinder 3 must first be removed from the lower steel 1.

More particularly, in order to remove the pierce punch from the lower steel 1, firstly, the nuts 2*a* fastening the hydraulic piping 2 and the pierce cylinder 33 must be released, and then the bolts (not shown) fastened to the fastening holes 3*a* formed on the top surface of the pierce cylinder 3 must be released.

It is necessary to firstly remove the pierce cylinder 3 because the one end portion 6' is firmly coupled to the recess portion 4' of the rod 4 by fitting by downwardly moving the pierce cylinder 3 while tightly adhering the pierce connector 6 to the lower steel 1 upon coupling in order to avoid the pierce connector 6 connected to the rod 4 from unstably moving upon punching the product by using the pierce punch 5.

After removing the pierce cylinder 3 from the lower steel 1, the pierce connector 6, the adjust plate 8, the punch holder 7, and the pierce punch 5 fastened to one another by the bolts (not shown) are sequentially removed from the lower steel 1, and the bolts fastened to the fastening holes 7*a* formed on the punch holder 7 are released to replace the pierce punch 5.

Meanwhile, it can be assumed that the pierce punch 5 is removed by disassembling only the punch holder 7 without disassembling the pierce cylinder 3 from the lower steel 1. In this case, however, the pierce punch 5 interferes with the pierce cylinder 3 during the removal of the pierce punch 5 inserted into the cavity of the lower steel 1.

As above, in order to remove the pierce punch 5 from the lower steel 1, the man-hour for removing the pierce cylinder 3 in advance is required and it thus takes much time replace the pierce punch 5.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

The present invention has been made in an effort to provide a piercing device of a hydroforming mold which allows the replacement of a pierce punch without disassembling a pierce cylinder from a lower steel.

In one aspect, the present invention provides a piercing device of a hydroforming mold with a lower steel having a cavity therein, the piercing device comprising: a pierce punch, the front edge portion of which is inserted into the cavity, for punching a hole through a molding material; a pierce cylinder for providing hydraulic pressure; a rod connected to the pierce cylinder, which is to be operated by the hydraulic pressure; and a pierce block connecting the rod and the pierce punch, wherein the length between the front edge portion of the rod and the pierce punch is greater than the length of the pierce punch.

In a preferred embodiment, the pierce block includes an upper block and a lower block that are disassembled and assembled in a direction perpendicular to the longitudinal direction of the pierce punch.

In another preferred embodiment, the upper block and the lower block are coupled to each other by a bolt fastening method in a direction perpendicular to the longitudinal direction of the pierce punch.

In still another preferred embodiment, a plurality of fastening holes are formed on the upper block and the lower block so as to fasten a plurality of bolts.

In yet another preferred embodiment, grooves for fitting and safely placing parts of the front edge portion of the rod thereon are formed on the facing faces of the upper block and the lower block, respectively.

In a further preferred embodiment, the pierce block further includes a punch holder disposed between one side face of the upper block and the pierce punch to hold the pierce punch.

In yet a further preferred embodiment, an adjust plate for firmly fastening the bolts is further placed between one side face of the upper block and the punch holder.

In still yet a further preferred embodiment, a plurality of bolts are fastened to fix the pierce punch to the upper block.

In a still further preferred embodiment, in the pierce block, the length between the front edge of the rod and the pierce punch is greater than the length of the pierce punch inserted into the cavity.

According to the present piercing devices, it is possible to replace the pierce punch without disassembling the pierce cylinder from the mold, thus saving the number of man-hours and the time taken for replacement.

Other aspects of the invention are discussed infra.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention, in which.

DETAILED DESCRIPTION

Figure 1:
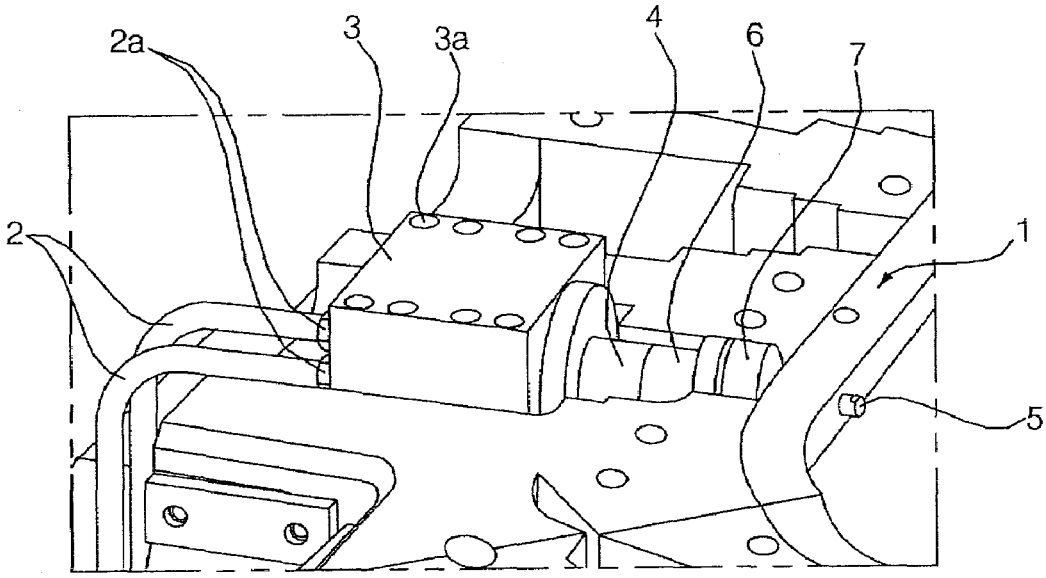
FIG. 1 is a perspective view showing a hydroforming mold in which a prior art piercing device is placed on a lower steel.
Figure 2:
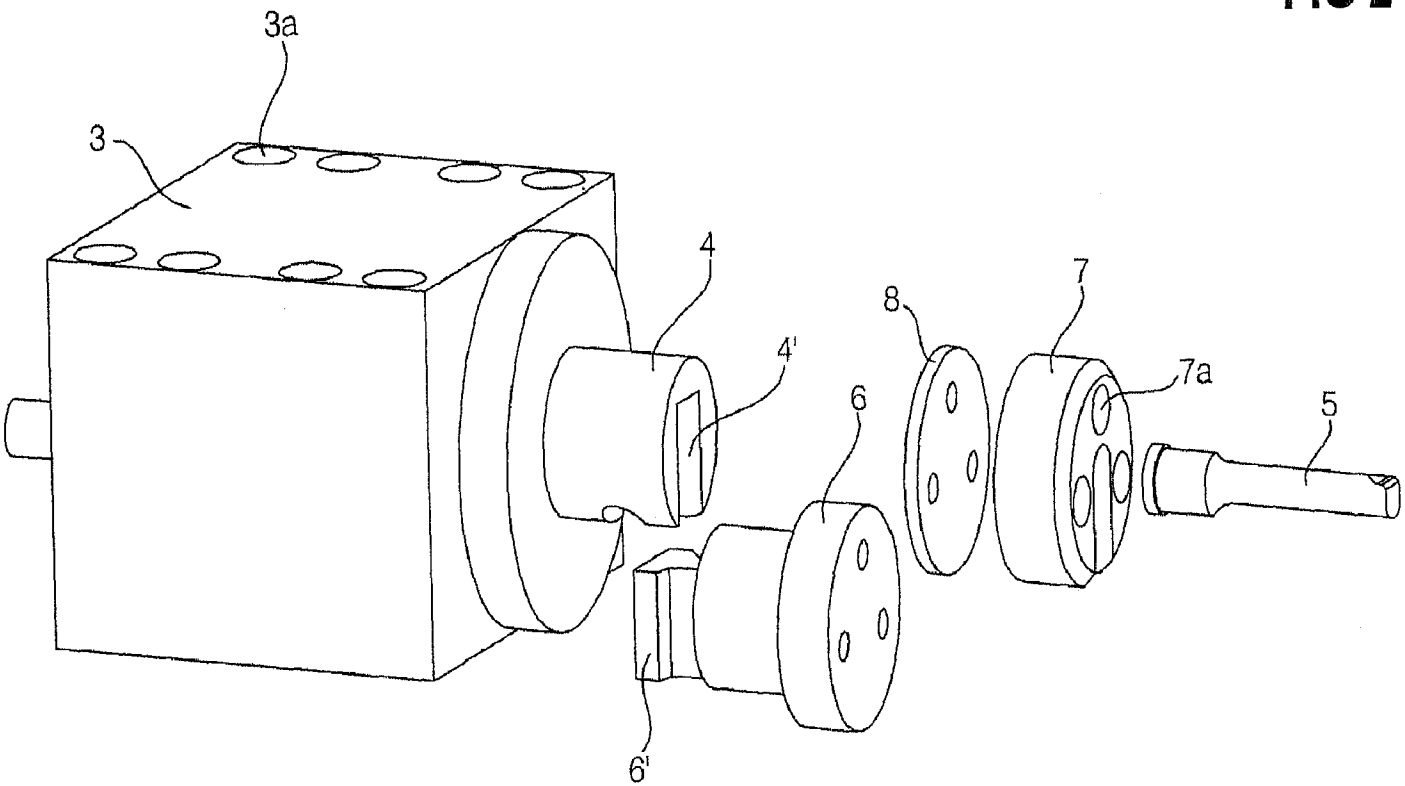
FIG. 2 is a block diagram of the piercing device of a hydroforming mold of FIG. 1.

Hereinafter, preferred embodiments of a piercing device of a hydroforming mold according to the present invention having the aforementioned effects will be described with reference to the accompanying drawings, wherein like reference numerals refer to like elements throughout. The embodiments are described below so as to explain the present invention by referring to the figures.

Figure 3:
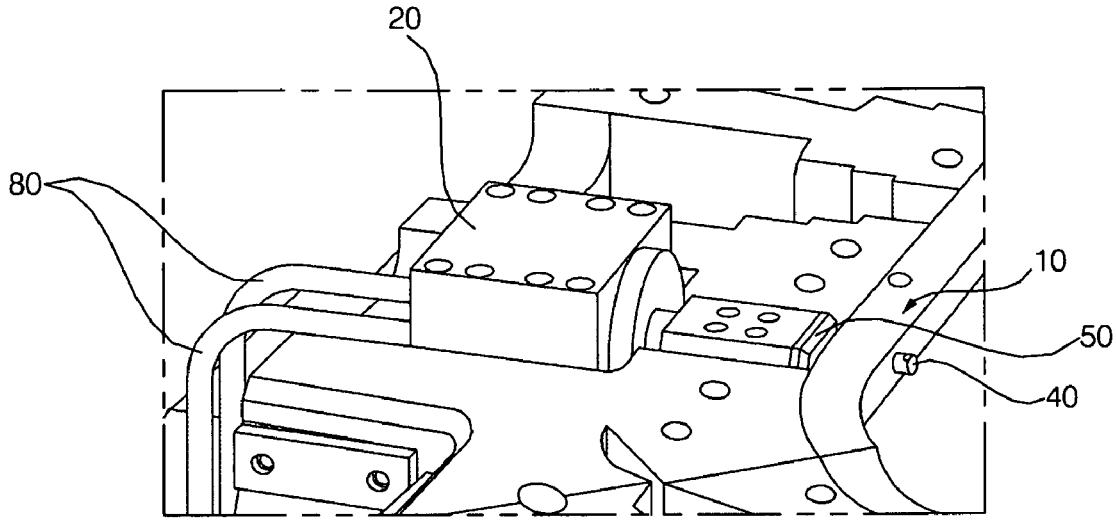
FIG. 3 is a perspective view showing a hydroforming mold in which a piercing device according to a preferred embodiment of the present invention is placed on a lower steel.
Figure 4:
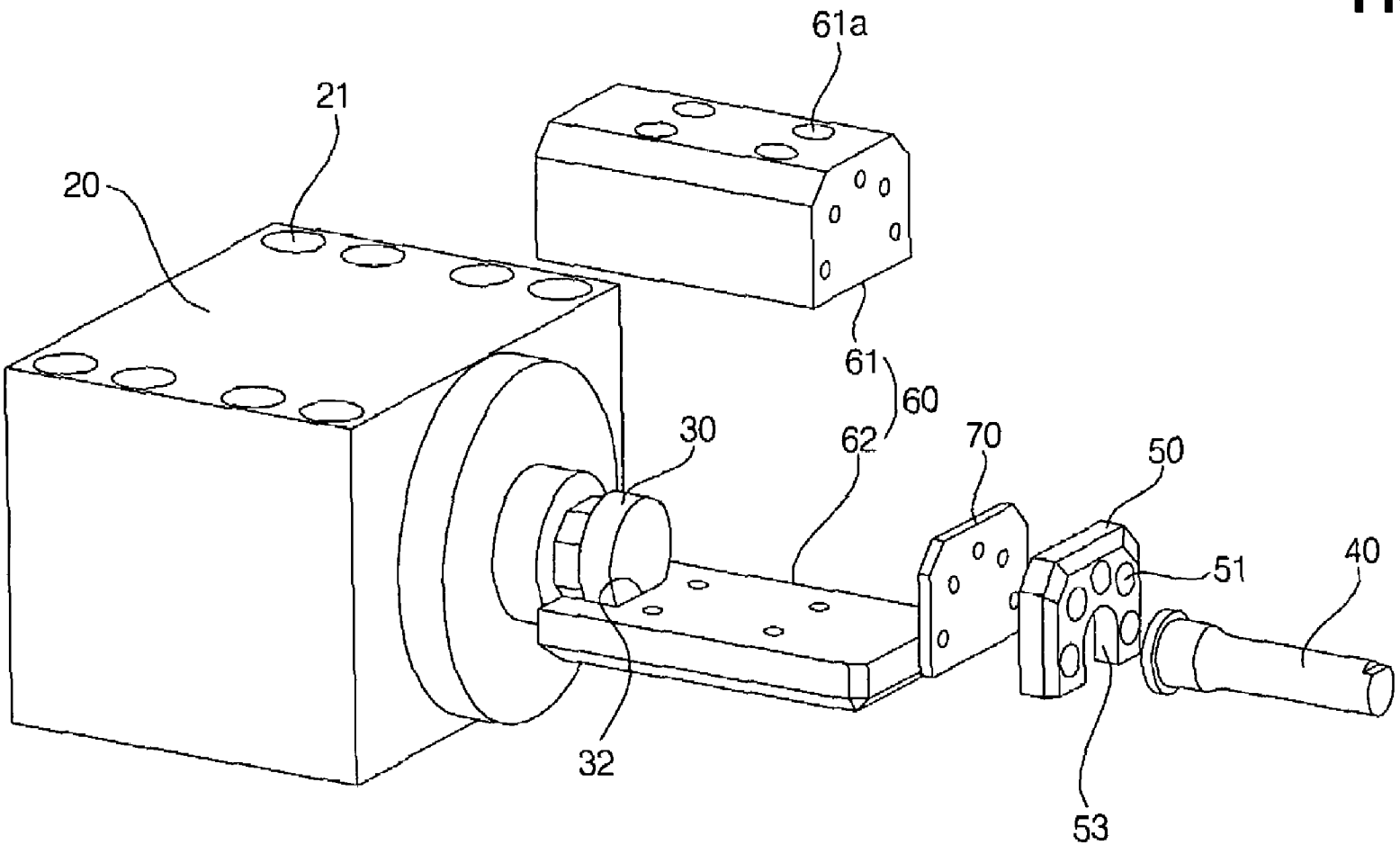
FIG. 4 is a block diagram of the piercing device of a hydroforming mold of FIG. 3.
Figure 5:
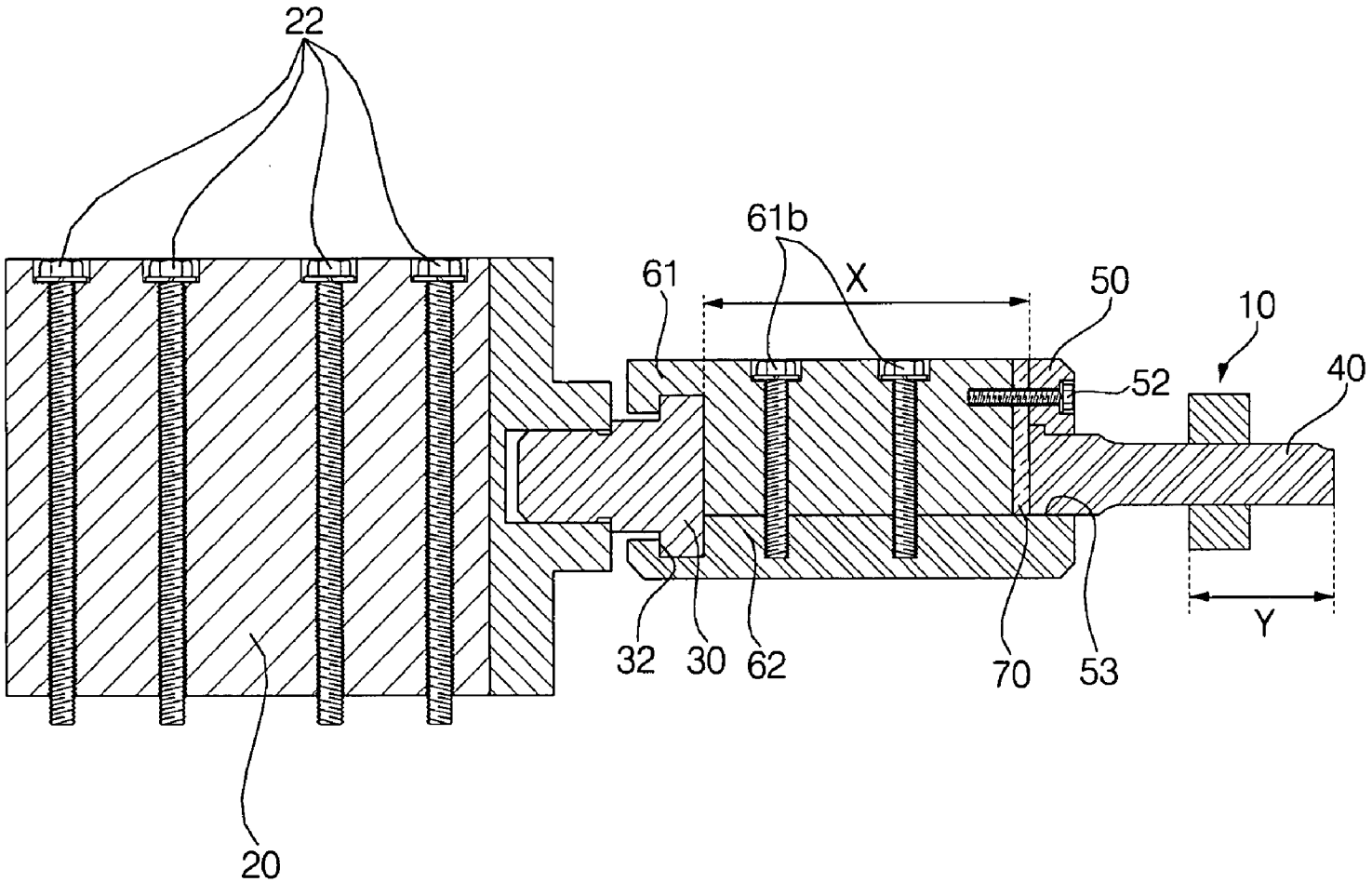
FIG. 5 is a cross sectional view of the piercing device of a hydroforming mold of FIG. 3.

FIG. 3 is a perspective view showing a hydroforming mold in which a piercing device according to a preferred embodiment of the present invention is placed on a lower steel;

FIG. 4 is a block diagram of the piercing device of a hydroforming mold of FIG. 3; and FIG. 5 is a cross sectional view of the piercing device of a hydroforming mold of FIG. 3.

The piercing device according to a preferred embodiment of the present invention is placed on a lower steel 10 of a hydroforming mold for punching a pierce hole through a molding material. A cavity for molding a product is provided within the lower steel 10.

The piercing device to be placed on the lower steel includes a pierce cylinder placed on the lower steel 10, a pierce punch 40 for punching a hole through a molding material by a rod 30 operating by hydraulic pressure of the pierce cylinder 20, and a punch holder 50 for holding the pierce punch 40 to the rod 30.

The pierce cylinder 20 is connected to hydraulic piping 80 to receive a hydraulic pressure.

A plurality of fastening holes 21 are formed on the top surface of the pierce cylinder 20, and the pierce cylinder 20 is fixed to the lower steel 10 by bolts 22 inserted into the fastening holes 21.

The piercing device according to the present invention includes a pierce block 60 disposed between the rod 30 and the pierce punch 40. The pierce block 60 is provided to not only mediate the connection between the rod 30 and the pierce punch 40 but also make it easier to disassemble and assemble the pierce punch 40 inserted and fixed into the cavity provided within the lower steel 10, as detailed below.

The pierce block 60 includes an upper block 61 and a lower block 62 so as to make assembling and disassembling easier. Fastening holes 61*a* are formed on the top surface of the upper block 61. The upper block 61 and the lower block 62 are fastened by bolts 61*b* fastened to the fastening holes 61*a* so that one faces thereof come into contact with each other.

Grooves 32 are formed on the facing faces of the upper block 61 and the lower block 62, respectively, so that a part of the front edge portion of the rod 30 is fit and safely placed thereon.

Herein, the lower block 62 is assembled by inserting the pierce punch 40 into a hole connected to the cavity formed inside the lower steel 10 from outside the lower steel 10 upon assembling the piercing device on the lower steel 10. The lower block 62 serves to guide the pierce punch 40 to be easily inserted into the hole of the lower steel.

The pierce block 60 further includes a punch holder 50 disposed between one side face of the upper block 61 and the pierce punch to hold the pierce punch to the one side face of the upper block 61. A plurality of fastening holes 51 are formed on the punch holder 50 so as to be penetrated in the longitudinal direction of the pierce block 60, and the pierce punch 40 is perpendicularly fixed to one side face of the upper block 61 by bolts (not shown) that are fastened to the one side face of the upper block 61 by penetrating through the fastening holes 51.

The lower end portion of the punch holder 50 is formed in an open 'U'-shape, with one end of the pierce punch 40 being fit and fixed to the open through hole 53. Thereupon, the lower end portion of the punch holder 50 is tightly adhered to the top surface of the lower block 62.

Additionally, an adjust plate 70 for firmly fastening the bolts 52 may be placed between the upper block 61 and the punch holder 50. The adjust plate 70 disposed between the upper block 61 and the punch holder 50 serves as a washer upon coupling the bolts.

The pierce block 60, as shown in FIG. 5, has the merit of securing a disassembly distance for replacement of the pierce punch 40 because the length X between the front edge of the rod 30 and the pierce punch 40 is greater than the length Y of penetrating and inserting the pierce punch 40 into the hole of the lower steel 10.

A disassembly process of the piercing device of a hydroforming mold will be described below.

First, the bolts 61*b* fastened to the fastening holes 61*a* of the upper block 61 are sequentially released, and then the bolts 52 fastened to the fastening holes 51 of the punch holder 50 are released.

Next, the pierce punch 40 is replaced by removing the upper block 61, the punch holder 50, and the adjust plate 70 from the lower block 62 by upward movement and then removing the pierce punch 40 from the hole of the lower steel 10 by the operation of horizontally moving the pierce punch 40 to the side at which the pierce cylinder 20 is disposed, being guided by the lower block 62.

Thereupon, the disassembly distance X of the pierce punch 40 to be horizontally moved from the hole in order to replace the pierce punch 40 is at least greater than the length Y of inserting the pierce punch 40 into the cavity by penetrating through the hole. Thus, it is possible to replace the pierce punch 40 only by disassembling the pierce block 60.

For instance, the preferred embodiment of the present invention has been described with respect to a case where the disassembly distance X of the pierce punch 40 is greater than the length Y of the pierce punch 40 penetrated into the cavity from outside the lower steel 10 in order to make the replacement of the pierce punch 40 easier, but not necessarily limited thereto, and it should be noted that any case in which the disassembly distance X of the pierce punch 40 is greater than the length of the pierce punch 40 is included in the scope of the embodiment of the present invention.

By using the piercing device according to the present invention, the pierce punch can be replaced without disassembling the pierce cylinder from the lower steel.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A piercing device of a hydroforming mold with a mold-steel having a cavity therein, the piercing device comprising:

a pierce punch, a front-end portion of which is inserted into the cavity, for punching a hole through a workpiece;

a pierce cylinder for providing hydraulic pressure;

a rod mounted at the pierce cylinder, such that the rod is operated by the hydraulic pressure; and a pierce block connecting the rod and the pierce punch, wherein the pierce block includes an upper block and a lower block that are disassembled and assembled in a direction perpendicular to the longitudinal direction of the pierce punch.

2. The piercing device of claim 1, wherein the upper block and the lower block are coupled to each other by a bolt fastening method in a direction perpendicular to the longitudinal direction of the pierce punch.

3. The piercing device of claim 2, wherein a plurality of fastening holes are formed on the upper block and the lower block so as to fasten a plurality of bolts.

4. The piercing device of claim 2, wherein grooves for fitting and safely placing parts of the front end portion of the rod thereon are formed on the facing faces of the upper block and the lower block, respectively.

5. The piercing device of claim 1, wherein the pierce block further includes a punch holder disposed between one side face of the upper block and the pierce punch to hold the pierce punch.

6. The piercing device of claim 5, wherein an adjusting plate for firmly fastening the bolts is further placed between one side face of the upper block and the punch holder.

7. The piercing device of claim 6, wherein a plurality of bolts are fastened to fix the pierce punch to the upper block.

8. The piercing device of claim 1, wherein in the pierce block, a length of the pierce block is greater than a length of the pierce punch inserted into the cavity.

* * * * *